United States Patent [19]

Viezee et al.

[11] 4,217,387

[45] Aug. 12, 1980

[54] PROCESS FOR THE MANUFACTURE OF A NON-WOVEN WEB FROM SYNTHETIC FILAMENTS

[75] Inventors: Dirk J. Viezee, Westervoort; Petrus J. M. Mekkelholt, Rheden; Johannes A. Juijn, Ce Velp, all of Netherlands

[73] Assignee: Akzona Incorporated, Asheville, N.C.

[21] Appl. No.: 945,394

[22] Filed: Sep. 25, 1978

[30] Foreign Application Priority Data

Sep. 26, 1977 [NL] Netherlands ..... 7710470

[51] Int. Cl.[2] ..... D04H 1/58; B29D 27/00

[52] U.S. Cl. ..... 428/288; 19/308; 28/103; 28/220; 156/167; 156/181; 264/210.3; 425/106

[58] Field of Search ..... 19/308; 156/181, 167; 28/1, 220, 103; 425/72 S, 106; 264/210 B; 65/5.2; 428/288

[56] References Cited

U.S. PATENT DOCUMENTS

| | | | |
|---|---|---|---|
| 2,450,914 | 10/1948 | Powell | 19/308 |
| 2,875,503 | 3/1959 | Frickert et al. | 156/181 |
| 2,886,877 | 5/1959 | Frickert et al. | 28/220 |
| 3,236,616 | 2/1966 | Stalego et al. | 65/5 |
| 3,314,122 | 4/1967 | Bundy | 28/1 |
| 4,095,312 | 6/1978 | Haley | 264/210 F |
| 4,111,672 | 9/1978 | Battigelli et al. | 425/7 |

FOREIGN PATENT DOCUMENTS

| | | | |
|---|---|---|---|
| 671734 | 10/1963 | Canada | 65/2 |
| 47-36225 | 9/1972 | Japan | 264/210 F |

*Primary Examiner*—Jay H. Woo

*Attorney, Agent, or Firm*—Francis W. Young; Jack H. Hall

[57] ABSTRACT

Manufacture of a non-woven web of man-made filaments in which one or more strands of filaments, directed parallel to each other, leaving one or more spinnerets are forwarded, each, by means of an air jet to a spreading plate for the filaments, and the resulting layer of spread filaments and air leaves the plate and advances to a moving support, upon which the filaments are deposited randomly to form a web which will then be bonded in known manner. In order to improve the isotropy of the web, the layer of spread filaments and air is guided to a fixed deflector plate forming a slit with the discharge edge of the stationary spreading plate, said slit allowing passage of the filaments but braking the air carried along with the filaments, and the layer is then subjected to an air jet directed transversely to the path of said deflected web and generally in a direction parallel to the surface of the moving support.

6 Claims, 2 Drawing Figures

1
2
19
18
15
3
17
4
6
5
7
11
16
8
12
10
9

1
2
19
18
15
3
4
13
7
14
16
5
6
12
8
10
9
11

PROCESS FOR THE MANUFACTURE OF A NON-WOVEN WEB FROM SYNTHETIC FILAMENTS

The invention relates to a process for the manufacture of a non-woven web from synthetic filaments, in which process one or more bundles of parallel filaments emerging from one or more spinning orifices are each directed onto a filament spreading plate by means of an air jet, which spreading plate is positioned at an angle to said air jet, and the resulting stream of spread filaments and air runs off the spreading plate, is deflected downwardly onto an advancing supporting device on which the filaments are deposited randomly in criss-cross fashion to form a web which is bonded in a manner known in itself.

The invention also relates to an apparatus comprising a spinning machine for synthetic filaments and a longitudinally advancing supporting device on which the filaments can be deposited to form a web, and at least one blower and a spreading plate for the filaments.

A process and an apparatus of the type indicated above are known for instance from the Netherlands Patent Application No. 7,216,267. In it a description is given of the manufacture of spun-bonded webs, by which are to be understood are webs that are made in one continuous operation starting with the spinning and drawing of filaments up to collecting them into a random arrangement on a supporting surface followed by at least provisionally bonding the filaments together in order that the required cohesion may be obtained. According to the above-mentioned patent specification these webs are made by spinning one or more bundles of filaments and subsequently drawing or stretching them by means of blowers through which the filament bundle is transported by fast flowing air. Subsequently, the air flowing from the blower flings the bundle onto an oscillating spreading plate which is positioned at an angle with the blowing device. As they hit the spreading plate, the filaments of the bundle are somewhat separated and form random loops on the surface of the spreading plate. The filaments thus spread slip off the plate and are caught by the accompanying air stream which carries them to a moving screen belt underneath which the air is sucked off and on which the filaments are left to form a randomly laid web. Spreading of the filaments is promoted in such a way that an air jet from a separate blower is directed at the point where the filaments hit the spreading plate. For the production of isotropic webs the spreading plate need be set into rapid oscillation. This requirement has its mechanical and acoustical drawbacks. The webs produced with a stationary spreading plate exhibit unequal properties in transverse and in longitudinal direction, as a result of which their application is inhibited in fields where high demands are made on the isotropy of the mechanical properties. This is particularly true in the case where such webs are used for textile purposes and as a reinforcement of bituminous sheets of roof covering material, as a carrier for spreading compounds or for laminated products such as some floor covering materials and insulating layers and for other technical purposes.

The object of the present invention is to improve the isotropy of webs with the air of stationary guiding devices, and more particularly to make webs of equal strength in longitudinal and in transverse direction. According to the invention this is realized in a simple manner by deflecting the stream of air and filaments slipping off the spreading plate towards the supporting device and exposing it to a transversely directed air jet, which leads to the bundle of filaments being opened considerably further and also to a statistically random orientation of the position of the filaments on the advancing screen belt of the supporting device.

The process according to the invention is characterized in that the stream of spread filaments and air is deflected towards the supporting device by a stationary deflecting plate which makes an angle of 10°–60° with the spreading plate and together with the run off or trailing edge of the stationary spreading plate forms a slit through which the filaments are passed and by which the air flowing along with them is slowed down and said stream is subsequently exposed to a transversely directed flat air jet which is substantially parallel to the surface of the supporting device. This process has the advantage that the web properties in longitudinal and in transverse direction can be varied with respect to each other in a simple manner by adjusting the position of the deflecting plate and by the strength of the flat air jet. The narrower the slit between the deflecting plate and the run off edge of the spreading plate, the more the filaments will be transversely positioned. The higher the strength of the flat air jet, the more the filaments will be forced to take up a transverse position, and hence, a greater longitudinal component. The blowing direction of the flat air jet may be chosen in the direction of movement of the supporting device or in opposite direction thereof or at some angle therewith. Although the invention is not limited to the use of flat plates and also use may be made of slightly curved plates, very good results are obtained by employing the less expensive and more readily adjustable flat spreading and deflecting plates.

The filaments are particularly well spread if the angle between the spreading plate and the first-mentioned air jet is 30°–60°. The angle between the deflecting plate and the spreading plate is preferably set to 15°–45°.

The process according to the invention is of particular interest if spun-bonded webs are made from a series of bundles of filaments spun from a row of spinning assemblies each having a large number of spinning orifices. A known practice is then to make use of a common spreading plate for all the filaments emerging from the row of spinning assemblies. A special embodiment of the process according to the invention offers the advantage that it makes it possible to obtain a web whose thickness and properties are remarkably uniform, which embodiment is characterized in that the stream of filaments and air of all bundles is collectively guided past a common deflecting plate and the flat air jet extends across the full width of said stream, i.e., in such a way that the filaments of adjacent bundles overlap to form a uniform web.

The common slit between the spreading plate and the deflecting plate for the filaments of all bundles and the use of the flat air jet promote intensive mixing of the filaments in transverse direction, so that a uniform web thickness is obtained.

The slit between the spreading plate and the deflecting plate must not be chosen unduly narrow, because a free passage of the highly intermingled filament is required in order to obtain a very uniform web. On the other hand, the slit must be chosen narrow enough that the air flowing along with the filaments and coming from the drawing and adjacent blowers is sufficiently slowed. The force of the remaining air stream which transports the filaments to the supporting device will then be sufficiently reduced for the filaments to be uniformly deposited on it and not be raised from it thereafter by the force of the air stream. It has been found that very favourable results are obtained with a slit width in the order of 5 to 15 mm in combination with a length of 100 to 300 mm both of the spreading plate and the deflecting plate and an air speed of 5 to 100 m/sec. of the flat air jet at the point where it hits the stream of filaments and transporting air. Such a speed can be realized at a low air pressure, which makes the process economical to carry out.

According to the invention, the apparatus for carrying out the above-mentioned process comprises a spinning machine for synthetic filaments and a longitudinally moving supporting defice on which the filaments are deposited to form a web, one or more blowers for the filaments and a spreading plate for the filaments which is disposed at an angle of from about 15° to about 75° from the vertical and positioned between a blower which draws or stretches the filaments as they are spun, and the supporting device and is characterized in that at some distance from the run off edge of a spreading plate there is provided a deflecting plate which forms a slit with it for the passage of the filaments and makes an angle of 10°-60° with the spreading plate. Between the deflecting plate and the supporting device there is provided a slit-shaped air blower whose slit has a blowing direction which is substantially parallel to the supporting device and a width which corresponds to that of the deflecting plate.

A special embodiment of the apparatus according to the invention comprises a spinning machine provided in transverse direction with a series of spinning assemblies below which there are positioned a series of blowers and a common spreading plate and characterized in that the deflecting plate extends at least across the width of the spreading plate. Immediately below the deflecting plate there is the slit-shaped blower, whose width corresponds to that of said two plates.

The process and the apparatus are particularly suitable to be used for making spun-bonded webs from filaments of polypropylene, polyamide and polyester such as polyethylene terephthalate. The filaments also may be of the composite type; for instance they may consist of a polyester core and a copolyester or polyamide sheath. It is preferred that the filaments should be spun from spinning assemblies having 25 to 500 spinning orifices and that they should have a count of dtex 1-15, although these values should not be interpreted as limitative. And the spinning speed, by which is to be understood the speed at which the blowers transport the filaments to the spreading plate, will as a rule be in the range of 500 to 6000 m/min. As the spinning speed increases to, say, above 2500 m/mim, generally a somewhat higher uniformity will be obtained. The forces required for drawing the filaments increase with increasing count of the filaments in the web, which necessitates the use of stronger blowers with higher air consumption in order that these forces may be transmitted to the filaments. There is no need for such a provision if the process is so carried out that subsequent to the spinning of the filaments they are passed over a driven set of rollers with the aid of which the filaments are oriented in the zone between the spinning orifice and these rollers, after which the drawn filaments are jetted onto the spreading plate by means of relatively light blowers.

In order that the web may have the necessary coherence it should be bonded, for instance by compressing it during a heat treatment in such a way that the filaments adhere to one another at their points of intersection. The web also may be bonded by needle-punching or with the air of a binder.

Since the webs made by the present process are highly isotropic as far as their mechanical properties are concerned, they are very suitable to be used in the field of clothing and household textile such as upholstery materials and in the technical field, for instance as filtering material, substrates for spreading compounds and for laminated products such as floor coverings, insulating layers, coating material, reinforcing layers for plastics and secondary carpet backing. The webs are also suitable for applications in civil engineering constructions, for instance when used in the form of drainage material. The thermally bonded webs from bicomponent filaments, more particularly those in the weight range of 100-300 g/m$^2$, are very suitable to be used as primary carpet backing and as reinforcing layer for instance for bituminous roof covering strips. The invention will be elucidated hereinafter with reference to the accompanying drawings.

In the two figures like parts are referred to by like numerals.

Figure 2:
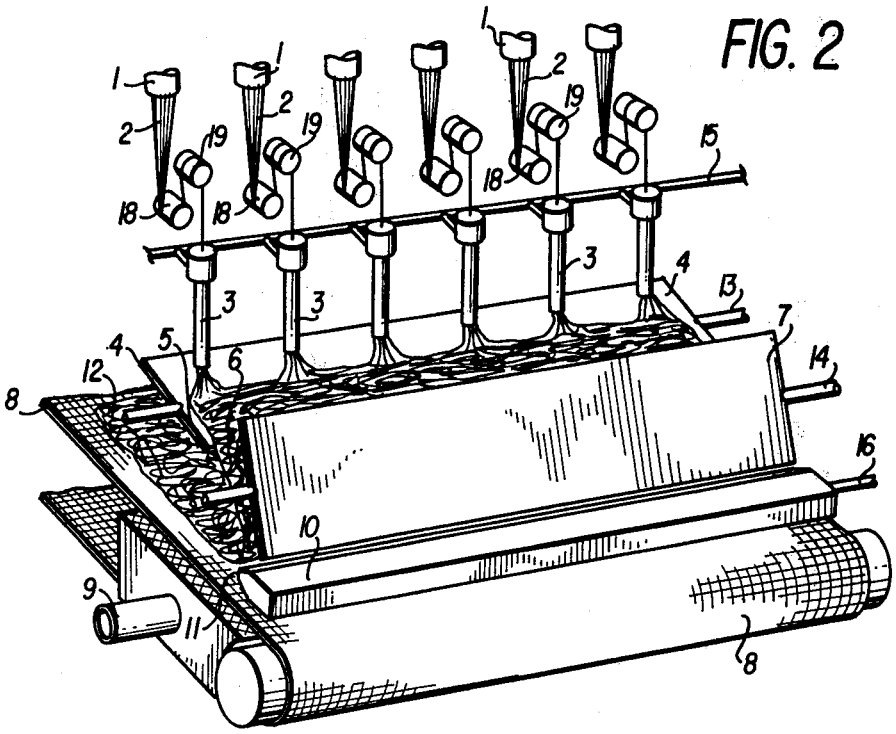
FIG. 2 is a perspective drawing of the apparatus having a common spreading plate and a common deflecting plate.

The numeral 1 refers to a spinning assembly of a spinning machine which is not further shown. The assembly 1 is provided with a number of spinning orifices from which a thread bundle 2 is spun. The bundle 2 is passed over driven rollers 18 and 19 and subsequently sucked in by the air blower 3, which is fed with compressed air supplied through the line 15. The speed of the rollers 18 and 19 may be so chosen that molecular orientation takes place in the filaments before they reach the rollers 18 and 19. From the blower the blower air and the filaments are jetted at high speed onto the surface of the spreading plate 4 positioned just below the outflow opening of the blower. Upon collision with the spreading plate the filament bundles will open. Directed at the spreading plate there is another air stream coming from the air blower 17, which is positioned quite near the blower 3, the lateral distance being, preferably, from about 30 mm. to about 100 mm. from the blower 3. The opened filament mass along with a strong air stream, leaves the spreading plate over the lower trailing edge 5 which together with the deflecting plate 7 from the slit 6. The remaining stream of air and filaments is deflected by the plate 7 in the direction of the endless screen belt 8. Positioned closely below the upper section of the screen belt is an air suction box 9 for withdrawing the air flowing along with the filaments. The blower 10 has a slit-shaped outlet opening 11 for the air directed at the stream of filaments just below the deflecting plate. The air is supplied through the line 16. The web is referred to by the numeral 12. FIG. 2 shows an apparatus for spinning six bundles of filaments and having a common spreading plate 4 and an equally wide deflecting plate 7. These plates are respectively provided with pivots 13 and 14, with which they can be adjustably mounted in the machine frame. For simplicity, neither the machine frame nor the support of the slit blower 10 are shown in the drawing.

EXAMPLE

Figure 1:
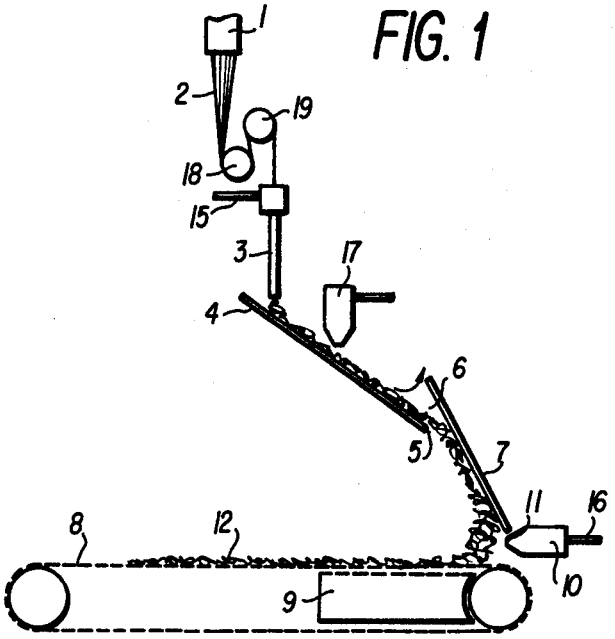
FIG. 1 is a side view of the apparatus according to the invention.

With the apparatus of FIG. 1 a spun-bonded web is made from polyethylene terephthalate filaments having a count of dtex 4. The spinning has 180 orifices from which the filaments are drawn away by the rollers 18 and 19. The rollers have a circumferential speed of 4400 m/min. The bundle 2 running off the rollers 18 and 19 is jetted onto the spreading plate at a speed of 4400 m/min by means of the blower 3. Just below the point where the bundle 2 hits the spreading plate 4 an air jet from the blower 17 is directed at the spreading plate 4, said jet having a starting speed of 200 m/sec. The distance from the point where the bundle hits the spreading plate to the run off edge is 16 cm and the angle of the stationary spreading plate with the vertical is 45°. The angle of the deflecting plate with the vertical is 20° and the slit between the spreading plate and the deflecting plate is 7 mm. Positioned immediately below the 12 cm-long deflecting plate is the blower 10 having a slit 0.5 mm wide from which air is blown at a speed of 40 m/sec. The distance from said blower 10 to the screen-shaped surface 8 is 25 cm. The filaments are deposited to form a web of 250 g/m$^2$ which is subsequently needle punched at a rate of 100 punches/cm$^2$.

The tenacity and the elongation at break of the web are measured in longitudinal and in transverse direction thereof.

The values obtained are given in the following table:

| | Tenacity N/5 cm | | | Percentage Elong. at break | | |
|---|---|---|---|---|---|---|
| | Long. Dir. (L) | Transverse Direction (D) | L/D | Long. Dir. (L) | Transverse Direction (D) | L/D |
| without using the blower 10 | 510 | 1130 | 0.45 | 90 | 70 | 1.28 |
| using the deflecting plate 7 and the blower 10 | 770 | 820 | 0.94 | 89 | 79 | 1.1 |

We claim:

1. A process for the manufacture of a non-woven web having a high degree of isotropy from synthetic filaments, comprising directing one or more bundles of said filaments emerging from one or more spinning orifices onto a stationary filament spreading plate by means of a latterally positioned air jet, said spreading plate being positioned at an angle to said air jet, advancing the resulting streams of spread filaments and air along said spreading plate, deflecting said stream of spread filaments and air downwardly at an angle of about 10°–60° from said spreading plate towards an advancing supporting device through a slit formed between the lower end of said stationary spreading plate and a stationary deflector plate, whereby said stream of air is slowed down, directing an air jet transversely to said deflected stream of filaments and parallel to the surface of said supporting device, depositing said stream of filaments in criss-cross configuration onto said advancing support device to form a web and bonding individual filaments to each other.

2. The process of claim 1 wherein a plurality of bundles are passed to said spreading plate, and said streams of filaments and air of all bundles are collectively guided past said deflecting plate and said transverse air jet extends across the full width of said stream of filament whereby the filaments of adjacent bundles overlap to form a uniform web.

3. The process of claim 1 wherein said slit has a width of from 5 to 15 mm.

4. The process of claim 3 wherein said stationary deflector plate is positioned at an angle to said supporting device.

5. The process of claim 1 wherein said laterally-positioned air jet is directed parallel to said emerging filaments.

6. A highly isotropic non-woven web made by the process of claims 1 or 2.

* * * * *